US012459623B2

(12) United States Patent
Tanaka

(10) Patent No.: US 12,459,623 B2
(45) Date of Patent: Nov. 4, 2025

(54) COOLING DEVICE FOR SHIP PROPULSION MACHINE

(71) Applicant: SUZUKI MOTOR CORPORATION, Hamamatsu (JP)

(72) Inventor: Yusuke Tanaka, Hamamatsu (JP)

(73) Assignee: SUZUKI MOTOR CORPORATION, Hamamatsu (JP)

( * ) Notice: Subject to any disclaimer, the term of this patent is extended or adjusted under 35 U.S.C. 154(b) by 462 days.

(21) Appl. No.: 18/150,848

(22) Filed: Jan. 6, 2023

(65) Prior Publication Data

US 2023/0219674 A1 Jul. 13, 2023

(30) Foreign Application Priority Data

Jan. 12, 2022 (JP) ..... 2022-003015

(51) Int. Cl.
*B63H 20/28* (2006.01)
*B63H 20/32* (2006.01)

(52) U.S. Cl.
CPC ..... *B63H 20/285* (2013.01); *B63H 20/32* (2013.01)

(58) Field of Classification Search
CPC ..... B63H 20/285; B63H 20/32
See application file for complete search history.

(56) References Cited

U.S. PATENT DOCUMENTS 10,336,428 B1 7/2019 Novak et al. ..... 440/88
10,501,160 B1 12/2019 Cooper, III et al.
2002/0182949 A1 12/2002 Tanaka et al. ..... 440/88
2018/0066555 A1* 3/2018 Langenfeld ..... F01N 3/046
2020/0309015 A1 10/2020 Watanabe ..... F01P 3/205
2021/0380213 A1 12/2021 Watanabe et al. ... B63H 20/285

FOREIGN PATENT DOCUMENTS

JP 2020-163872 A 10/2020
JP 2021-191652 A 12/2021

OTHER PUBLICATIONS

Extended European Search Report dated Jun. 9, 2023, issued by the European Patent Office in corresponding application EP 23150865.6.
Notice of Reasons for Refusal dated Mar. 11, 2025, Issued by the Japanese Patent Office in corresponding application JP 2024-220368.

* cited by examiner

*Primary Examiner* — Stephen P Avila
(74) *Attorney, Agent, or Firm* — Stein IP, LLC

(57) ABSTRACT

A cooling device for a ship propulsion machine includes a drain passage and a collector. The collector includes a collector main body, a case, an upper connection pipe, and a lower connection pipe having flexibility. A first bent portion is provided between an upper end portion and a lower end portion of the lower connection pipe. A second bent portion is provided between the first bent portion and the lower end portion of the lower connection pipe. The lower connection pipe extends downward from the upper end portion thereof along an axis of the case, bends at the first bent portion, extends downward while being inclined with respect to the axis so as to be separated from the axis, bends at the second bent portion, and extends downward while being inclined with respect to the axis so as to be close to the axis.

6 Claims, 9 Drawing Sheets

COOLING DEVICE FOR SHIP PROPULSION MACHINE

CROSS-REFERENCE TO RELATED APPLICATIONS

The disclosure of Japanese Patent Application No. 2022-003015 filed on Jan. 12, 2022, including specification, drawings and claims is incorporated herein by reference in its entirety.

TECHNICAL FIELD

The present disclosure relates to a cooling device for a ship propulsion machine having a function of collecting fine objects diffused in water such as seawater and lake water.

BACKGROUND ART

In recent years, there has been a problem of contamination of sea, lake, rivers, and the like caused by diffusion of fine waste such as microplastic into water such as seawater, lake water, or river water. It is known that sea, lake, river, and the like are polluted by dregs of feed used for aquaculture diffused in water such as seawater, lake water or river water. In order to prevent such contamination, it is desired to collect and recover fine waste such as microplastic, dregs of feed, and the like (hereinafter, referred to as "fine objects").

Patent Literature 1 listed below describes an outboard motor in which a cooling device having a function of collecting fine objects is mounted. The cooling device uses a pump to take water such as seawater or lake water into the outboard motor, and supplies the taken water as cooling water to a water jacket provided in an engine of the outboard motor. The cooling water supplied to the water jacket flows through the water jacket, thereby cooling the engine. In addition, the cooling water after flowing through the water jacket flows through a drain pipe, passes through the inside of a filter device provided in the middle of the drain pipe, and is then discharged to the outside of the outboard motor. When the cooling water passes through the filter device, the fine objects in the cooling water are captured by the filter device and removed from the cooling water. In this way, according to the cooling device, seawater, lake water, or the like can be taken into the outboard motor, and fine objects contained in the taken seawater, lake water, or the like can be collected by the filter device.

Patent Literature 1: JP2020-163872A

FIG. 9A shows a drain pipe and a filter device in a cooling device shown in FIG. 3 of Patent Literature 1. In FIG. 9A, a reference numeral 133 denotes the drain pipe, and a reference numeral 135 denotes the filter device. FIG. 9B shows a state in which the drain pipe 133 and the filter device 135 in FIG. 9A are viewed from a direction indicated by an arrow S in FIG. 9A. In FIGS. 9A and 9B, arrows X indicate a flow direction of the cooling water in the drain pipe 133 and the filter device 135. As shown in FIG. 9B, in the cooling device of Patent Literature 1, since the cooling water flows while being largely bent in the filter device 135, a pressure loss in the flow path of the cooling water increases, and the flow of the cooling water may deteriorate.

Therefore, in order to prevent an increase in the pressure loss in the flow path of the cooling water, as shown in FIG. 10, a method is conceivable in which a drain passage for supplying the cooling water after flowing through the water jacket to a water discharge port of the outboard motor is divided into an upper drain passage portion 201 and a lower drain passage portion 202, and a filter device 203 is disposed between the upper drain passage portion 201 and the lower drain passage portion 202 coaxially with the upper drain passage portion 201 and the lower drain passage portion 202. According to this method, as indicated by arrows Y in FIG. 10, the cooling water flows linearly through the upper drain passage portion 201, the filter device 203, and the lower drain passage portion 202, and therefore it is possible to prevent an increase in a pressure loss in the flow path of the cooling water, and it is possible to improve the flow of the cooling water.

However, when the filter device 203 is disposed between the upper drain passage portion 201 and the lower drain passage portion 202 coaxially with the upper drain passage portion 201 and the lower drain passage portion 202, it is difficult to remove the filter device 203 from between the upper drain passage portion 201 and the lower drain passage portion 202, which makes it difficult to perform maintenance of the filter device 203 (for example, removal of fine objects accumulated in a filter or the like).

That is, a lower end portion of the upper drain passage portion 201 is inserted into and fitted to an upper portion of the filter device 203, and an upper end portion of the lower drain passage portion 202 is inserted into and fitted to a lower portion of the filter device 203. Therefore, in order to remove the filter device 203 from between the upper drain passage portion 201 and the lower drain passage portion 202, it is necessary to move the filter device 203 in an upper-lower direction with respect to the upper drain passage portion 201 or the lower drain passage portion 202 by moving the filter device 203 downward with respect to the lower end portion of the upper drain passage portion 201 so that the upper drain passage portion 201 and the filter device 203 can be separated from each other, or by moving the filter device 203 upward with respect to the upper end portion of the lower drain passage portion 202 so that the lower drain passage portion 202 and the filter device 203 can be separated from each other, for example. However, when the upper drain passage portion 201 and the lower drain passage portion 202 are pipes, hoses, or the like having high rigidity, it is difficult to move the filter device 203 sandwiched between the upper drain passage portion 201 and the lower drain passage portion 202 upward and downward. Therefore, it is difficult to remove the filter device 203 from between the upper drain passage portion 201 and the lower drain passage portion 202.

In this regard, if a rubber hose or the like having low rigidity is used as the upper drain passage portion 201 or the lower drain passage portion 202, the filter device 203 can be easily removed from between the upper drain passage portion 201 and the lower drain passage portion 202 by bending the rubber hose by hands. However, the upper drain passage portion 201 and the lower drain passage portion 202 need to have improved durability against vibration, an impact, heat, or the like. For this reason, even when a rubber hose is used as the upper drain passage portion 201 or the lower drain passage portion 202, it is necessary to use, for example, a rubber hose containing reinforcing fibers or a thick rubber hose, and as a result, the rigidity of the rubber hose is increased. That is, in order to meet the need to increase the durability of the upper drain passage portion 201 and the lower drain passage portion 202, it is difficult to use a rubber hose or the like having low rigidity that can be easily bent by hands as the upper drain passage portion 201 or the lower drain passage portion 202.

The present disclosure has been made in view of, for example, the above-described problems, and an object of the present disclosure is to provide a cooling device for a ship propulsion machine capable of facilitating maintenance of a collector (filter device) that collects fine objects while preventing deterioration of a flow of cooling water.

SUMMARY

In order to solve the above problem, there is provided a cooling device for a ship propulsion machine, the cooling device being provided in the ship propulsion machine, taking water of an outside of the ship propulsion machine into the ship propulsion machine, cooling a power source of the ship propulsion machine by flowing the taken water around or inside the power source as cooling water, and discharging the cooling water after flowing around or inside the power source to outside of the ship propulsion machine, the cooling device including: a drain passage configured to discharge the cooling water after flowing around or inside the power source to the outside of the ship propulsion machine; and a collector provided between an upstream portion and a downstream portion of the drain passage and configured to collect a fine object contained in the cooling water flowing from the upstream portion of the drain passage toward the downstream portion of the drain passage. The collector includes a collector main body configured to collect the fine object, through which the cooling water passes, a case having a tubular shape having an axis extending in an upper-lower direction and accommodating the collector main body, an upper connection pipe extending in the upper-lower direction, whose upper end portion is connected to the upstream portion of the drain passage, whose lower end portion is connected to an upper portion of the case, and through which the cooling water flows from the upstream portion of the drain passage into the case, and a lower connection pipe having flexibility, whose upper end portion is connected to a lower portion of the case, whose lower end portion is connected to the downstream portion of the drain passage, and through which the cooling water flows from the case into the downstream portion of the drain passage. A first bent portion is provided between the upper end portion and the lower end portion of the lower connection pipe. A second bent portion is provided between the first bent portion and the lower end portion of the lower connection pipe. The lower connection pipe extends downward from the upper end portion thereof along an axis of the case, bends at the first bent portion, extends downward while being inclined with respect to the axis so as to be separated from the axis, bends at the second bent portion, and extends downward while being inclined with respect to the axis so as to be close to the axis.

DESCRIPTION OF EMBODIMENTS

A cooling device for a ship propulsion machine according to an embodiment of the present disclosure is a cooling device that is provided in the ship propulsion machine, takes water outside the ship propulsion machine into the ship propulsion machine, cools a power source of the ship propulsion machine by flowing the taken water to around or inside the power source as cooling water, and discharges the cooling water after flowing around or inside the power source to outside of the ship propulsion machine. The cooling device includes a drain passage for discharging the cooling water after flowing around or inside the power source to the outside of the ship propulsion machine, and a collector provided between an upstream portion and a downstream portion of the drain passage and configured to collect a fine object contained in the cooling water flowing from the upstream portion of the drain passage toward the downstream portion of the drain passage.

The collector includes a collector main body that collects the fine object and allows the cooling water to pass therethrough, a case that is formed in a tubular shape having an axis extending in an upper-lower direction and accommodates the collector main body, an upper connection pipe that extends in the upper-lower direction, whose upper end portion is connected to the upstream portion of the drain passage, whose lower end portion is connected to an upper portion of the case, and through which the cooling water flows from the upstream portion of the drain passage into the case, and a lower connection pipe that has flexibility, whose upper end portion is connected to a lower portion of the case, whose lower end portion is connected to the downstream portion of the drain passage, and through which the cooling water flows from the case into the downstream portion of the drain passage.

A first bent portion is provided between the upper end portion and the lower end portion of the lower connection pipe, and a second bent portion is provided between the first bent portion and the lower end portion of the lower connection pipe. Further, the lower connection pipe extends downward from the upper end portion thereof along an axis of the case, bends at the first bent portion, extends downward while being inclined with respect to the axis so as to be separated from the axis, bends at the second bent portion, and then extends downward while being inclined with respect to the axis so as to be close to the axis.

Figure 9A:
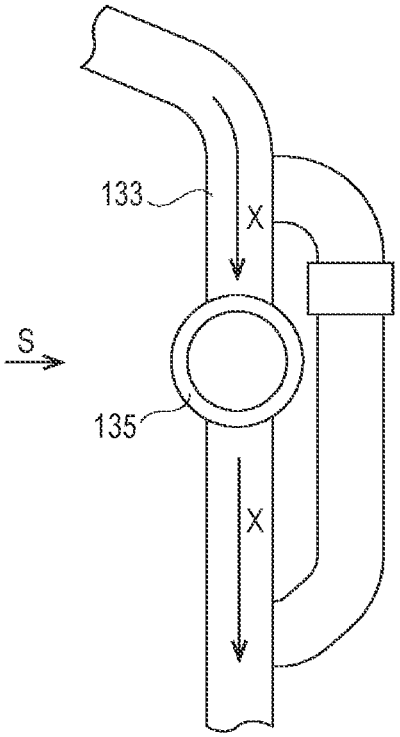
FIGS. 9A and 9B are explanatory views showing a drain pipe and a filter device in a cooling device of the related art.
Figure 9B:
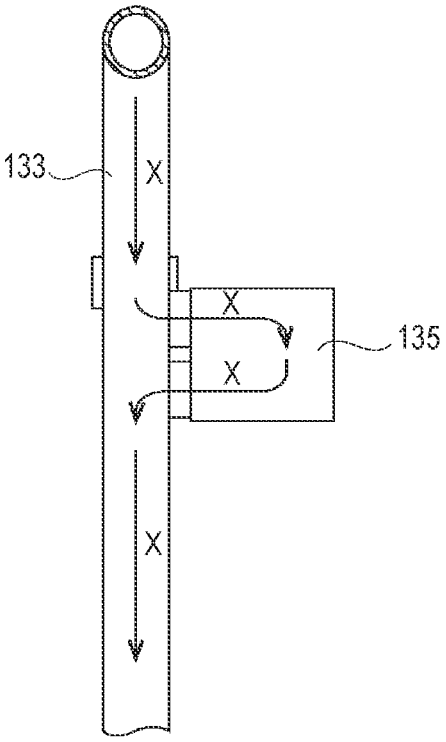
Figure 10:
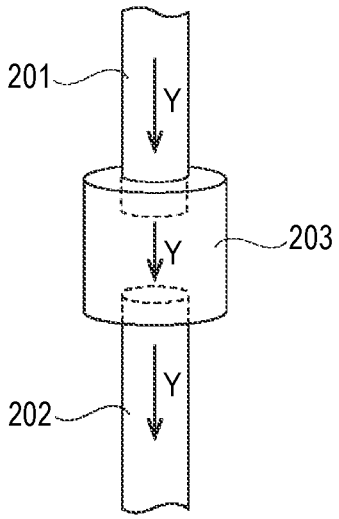
FIG. 10 is an explanatory view showing the filter device and a drain passage portion disposed coaxially with each other.

In the cooling device of the present embodiment, the case is formed in a tubular shape having the axis extending in the upper-lower direction, and the upper connection pipe extends in the upper-lower direction between the upstream portion of the drain passage and the case. Although the lower connection pipe includes the first bent portion and the second bent portion, a portion of the lower connection pipe from the upper end portion to the first bent portion extends downward along the axis of the case, a portion of the lower connection pipe from the first bent portion to the second bent portion extends downward while being inclined with respect to the axis of the case, and a portion of the lower connection pipe from the second bent portion to the lower end portion extends downward while being inclined with respect to the axis of the case. Therefore, the lower connection pipe extends in the upper-lower direction between the case and the downstream portion of the drain passage as a whole. As described above, a flow path of the cooling water in the collector provided between the upstream portion of the drain passage and the downstream portion of the drain passage is not greatly bent, unlike the flow path of the related art shown in FIG. 9B. Therefore, it is possible to prevent an increase in a pressure loss in the flow path of the cooling water in the collector, and it is possible to improve the flow of the cooling water in the collector.

In addition, in the collector of the cooling device of the present embodiment, the first bent portion and the second bent portion are provided in the lower connection pipe, and the portion of the lower connection pipe from the first bent portion to the second bent portion and the portion of the lower connection pipe from the second bent portion to the lower end portion are inclined with respect to the axis of the case extending in the upper-lower direction. Therefore, when the user grips an upper portion of the lower connection pipe with his/her hand and applies a downward force, the user can easily bend the lower connection tube and easily move the upper end portion of the lower connection pipe downward. For example, when the upper end portion of the lower connection pipe is moved downward so that the case can be removed from the upper connection pipe and the lower connection pipe, or when the upper end portion of the lower connection pipe is moved downward so that a part of the case can be separated from the case, the user can easily perform maintenance of the collector main body accommodated in the case (for example, removal of fine objects accumulated in the collector main body).

Embodiment

Hereinafter, an embodiment of a cooling device for a ship propulsion machine according to the present disclosure will be described with reference to FIGS. 1 to 8. Note that in this embodiment, front (Fd), rear (Bd), upper (Ud), lower (Dd), left (Ld), and right (Rd) directions are described following arrows drawn at a lower left in FIGS. 1 to 8.

(Outboard Motor)

Figure 1:
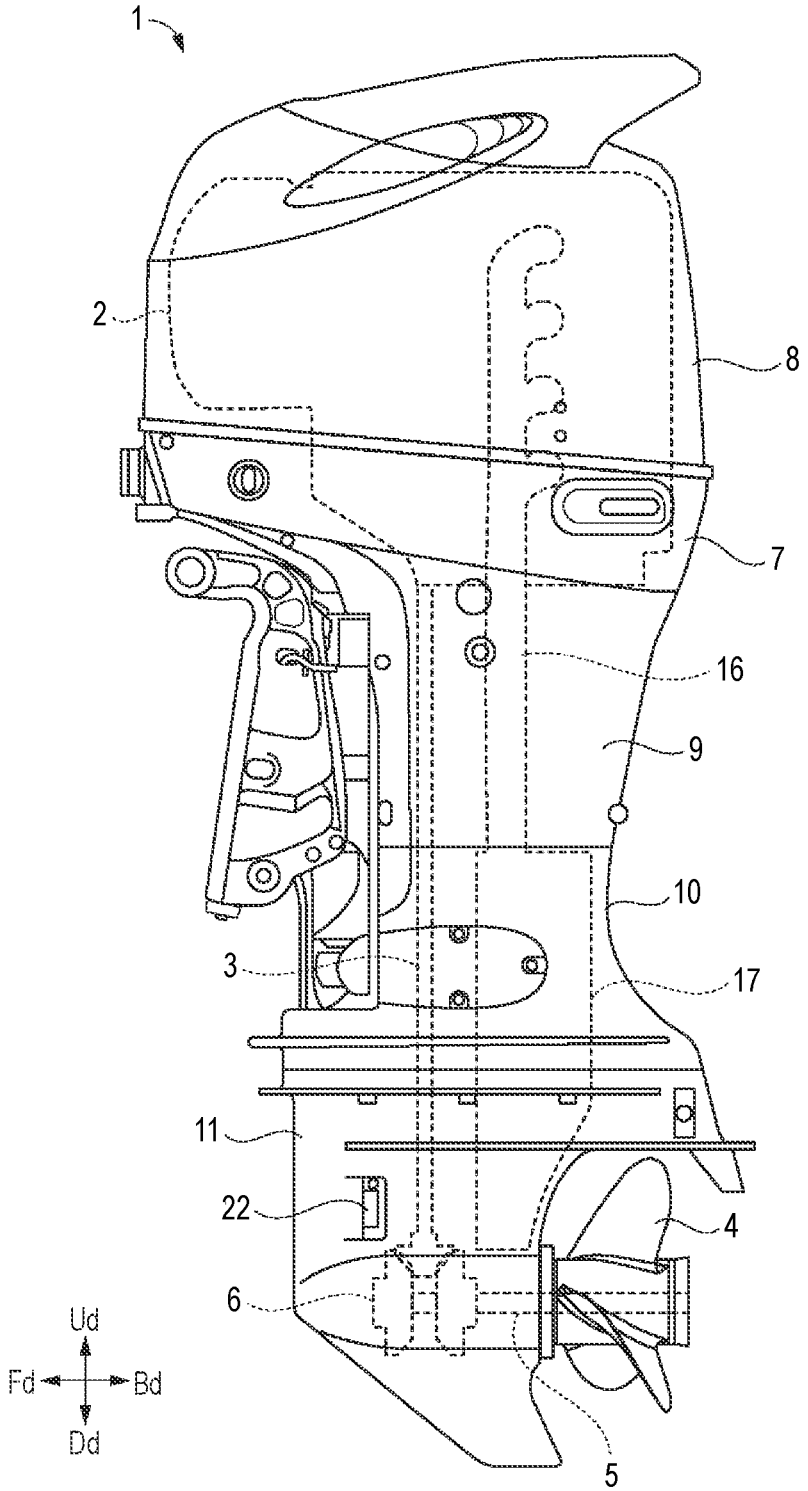
FIG. 1 is an overall view showing an outboard motor provided with a cooling device according to an embodiment of the present disclosure.

FIG. 1 shows an entire outboard motor 1, which is an embodiment of a ship propulsion machine, as viewed from the left. As shown in FIG. 1, the outboard motor 1 includes an engine 2 as a power source, a drive shaft 3 that rotates by receiving power of the engine 2, a propeller 4 that generates a propulsive force of a ship, a propeller shaft 5 to which the propeller 4 is attached, and a gear mechanism 6 that transmits the rotation of the drive shaft 3 to the propeller shaft 5. Although not shown, the gear mechanism 6 is provided with a shift device that switches the direction of rotation transmitted from the drive shaft 3 to the propeller shaft 5. The engine 2 is disposed at an upper portion of the outboard motor 1. The gear mechanism 6, the propeller shaft 5, and the propeller 4 are disposed at a lower portion of the outboard motor 1. The drive shaft 3 extends in an upper-lower direction between the engine 2 and the gear mechanism 6.

A lower portion of the engine 2 is covered with an engine bottom cover 7, and a middle portion and an upper portion of the engine 2 in the upper-lower direction are covered with an engine top cover 8. The engine top cover 8 is detachably attached to the engine bottom cover 7. By removing the engine top cover 8, it is possible to expose a wide range of the engine 2 from the middle portion to the upper portion in the upper-lower direction. In addition, an upper portion of the drive shaft 3 is covered with an upper case 9, and a middle portion of the drive shaft 3 in the upper-lower direction is covered with a middle case 10. A lower portion of the drive shaft 3, the gear mechanism 6, and a front portion of the propeller shaft 5 are covered with a lower case 11.

Figure 2:
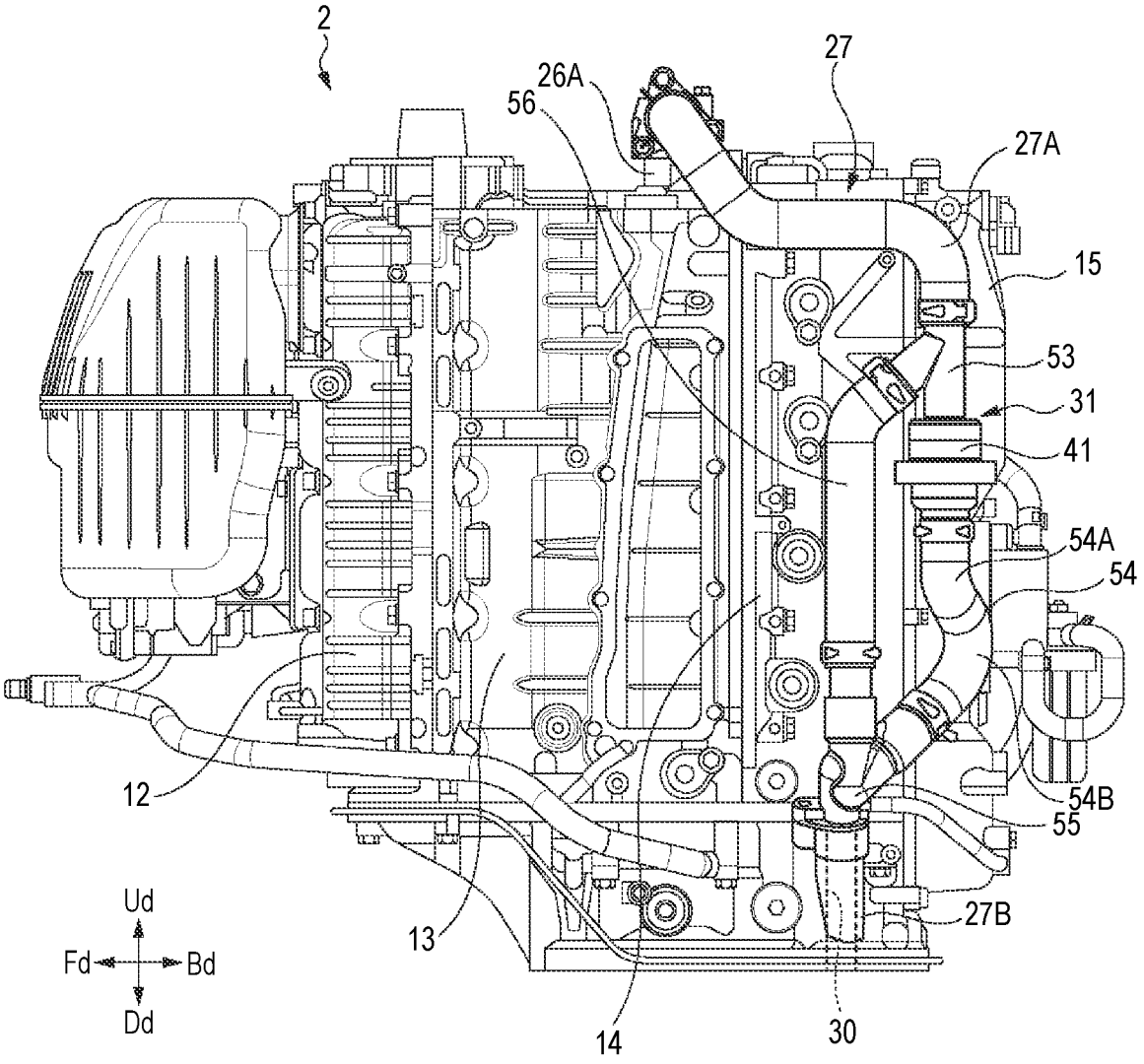
FIG. 2 is an external view showing an engine of the outboard motor according to the embodiment of the present disclosure as viewed from the left.
Figure 3:
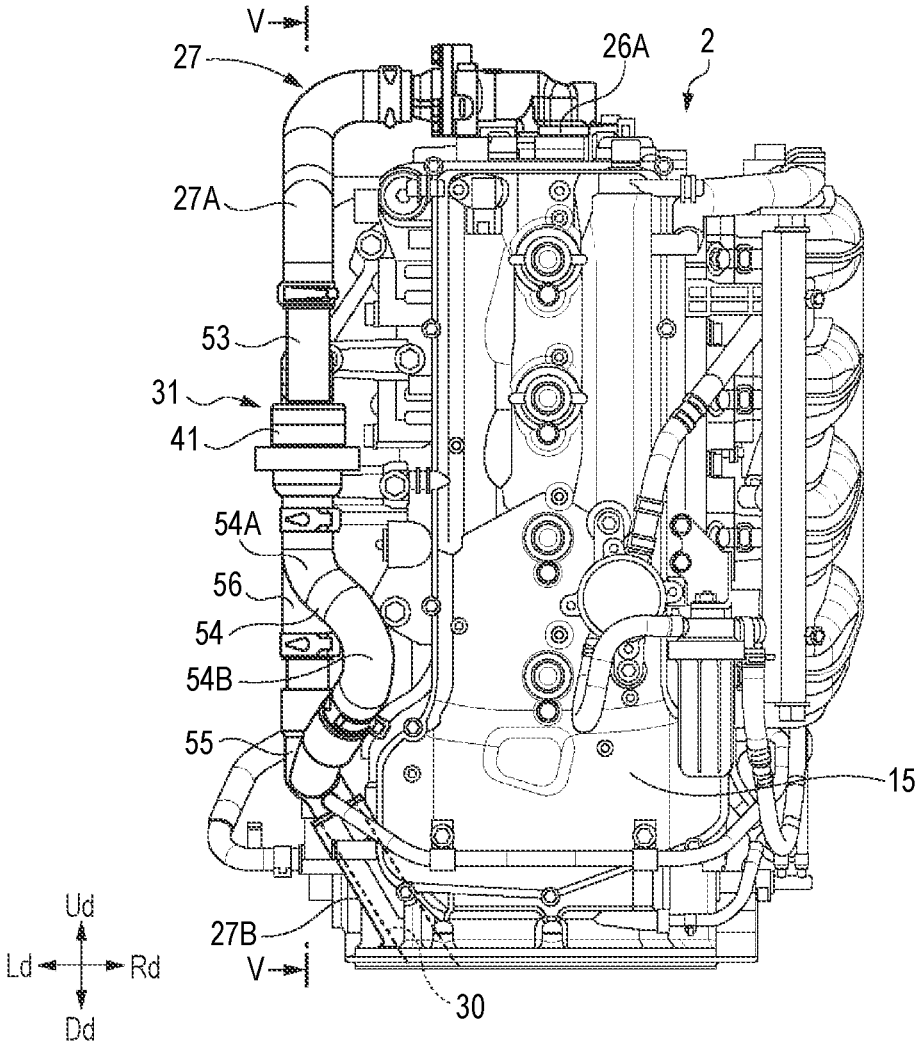
FIG. 3 is an external view showing the engine in FIG. 2 as viewed from the rear.

FIG. 2 shows the engine 2 as viewed from the left. FIG. 3 shows the engine 2 as viewed from the rear. The engine 2 is, for example, a four-cycle four-cylinder gasoline engine, and a cooling method of the engine 2 is a water cooling method. The engine 2 is disposed such that an extending direction of a crankshaft is the upper-lower direction. As shown in FIG. 2, in the engine 2, a crankcase 12 is disposed in a front portion, a cylinder block 13 is disposed behind the crankcase 12, and a cylinder head 14 is disposed behind the cylinder block 13. A rear portion of the cylinder head 14 is covered with a cylinder head cover 15.

As shown in FIG. 1, the outboard motor 1 is provided with an exhaust passage 16 for discharging exhaust gas discharged from the engine 2 to the outside of the outboard motor 1. An upper end side of the exhaust passage 16 is connected to an exhaust port provided in the cylinder head 14 of the engine 2, and a lower end side of the exhaust passage 16 is connected to an exhaust chamber 17 provided at a rear portion of a lower portion of the outboard motor 1. In the outboard motor 1 of the present embodiment, the exhaust chamber 17 is provided in a portion from a rear portion in the middle case 10 to a rear portion in the lower case 11. The exhaust gas discharged from the exhaust port of the engine 2 is sent to the exhaust chamber 17 via the exhaust passage 16, and then discharged to the outside of the outboard motor 1 via, for example, a discharge port provided in a shaft portion of the propeller 4. In FIGS. 2 and 3, the exhaust port of the engine 2 and the exhaust passage 16 are not shown.

(Cooling Device)

Figure 4:
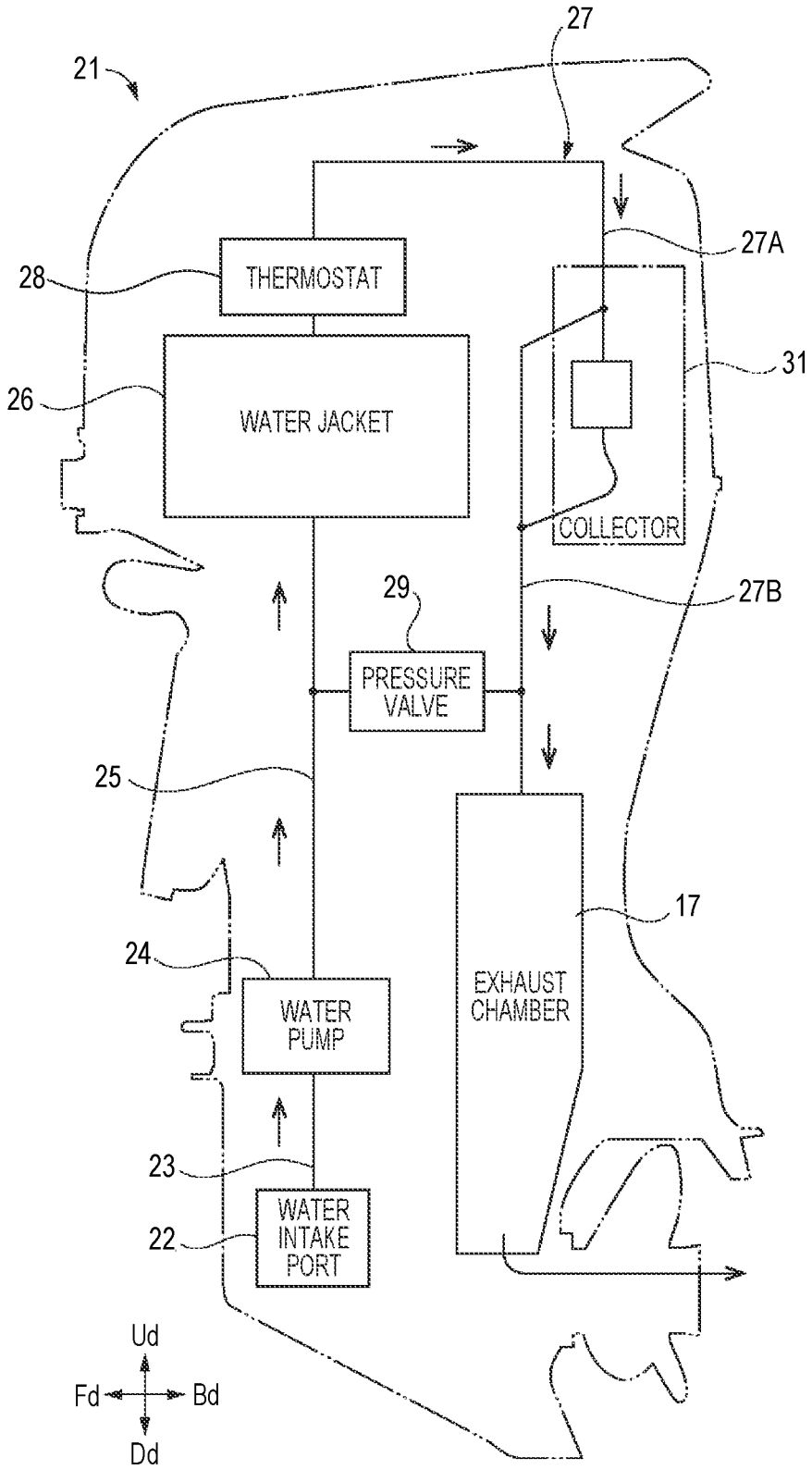
FIG. 4 is an explanatory view showing a configuration of the cooling device according to the embodiment of the present disclosure.

The outboard motor 1 includes a cooling device 21 for cooling the engine 2 and other heat generating portions in the outboard motor 1 by using water around the outboard motor 1, such as seawater, lake water, or river water, as cooling water. FIG. 4 shows a configuration of the cooling device 21.

As shown in FIG. 4, the cooling device 21 includes a water intake port 22, a water intake passage 23, a water pump 24, a water supply passage 25, a water jacket 26, a drain passage 27, a thermostat 28, a pressure valve 29, and a collector 31.

The water intake port 22 is a port through which water around the outboard motor 1 is taken into the outboard motor 1, and is provided in a portion of the outboard motor 1 that is submerged below water, specifically, in a part of the lower case 11 (see FIG. 1). In addition, the water intake port 22 is provided with a strainer or a cover having a large number of small holes for preventing an object larger than a fine object, such as a stone or algae, from entering the outboard motor 1 together with seawater, lake water, river water, or the like.

The water intake passage 23 is a passage for causing the water pump 24 to absorb water taken into the outboard motor 1 from the water intake port 22, and is provided inside the lower case 11.

The water pump 24 is a pump that absorbs water taken into the outboard motor 1 from the water intake port 22 and discharges the absorbed water as the cooling water, and is provided, for example, inside the lower case 11 or the middle case 10. Further, the water pump 24 is operated by utilizing the rotation of the drive shaft 3.

The water supply passage 25 is a passage for supplying the cooling water discharged from the water pump 24 to the water jacket 26, and is formed of, for example, a hose, a pipe, or the like provided inside the middle case 10, the upper case 9, and the engine bottom cover 7.

The water jacket 26 is a mechanism that cools the engine 2 by causing the cooling water supplied through the water supply passage 25 to flow around or inside the engine 2, and is provided around or inside the engine 2.

The drain passage 27 is a passage for discharging the cooling water after flowing through the water jacket 26 to the outside of the outboard motor 1, and is formed of, for example, a hose or a pipe provided inside the engine top cover 8, the engine bottom cover 7, the upper case 9, and the like. As shown in FIG. 2, an upstream end portion of the drain passage 27 is connected to an outlet 26A of the water jacket 26 disposed in an upper portion of the cylinder head 14. In addition, the drain passage 27 extends from the outlet 26A of the water jacket 26 to an upper left side of a rear portion of the engine 2, passes through the collector 31, and then extends downward inside the engine bottom cover 7 and the upper case 9. As shown in FIG. 4, a downstream end portion of the drain passage 27 is connected to the exhaust chamber 17.

The thermostat 28 is a device that limits the flow of the cooling water in order to warm up the engine 2 or in order to prevent supercooling of the engine 2, and is provided, for example, in the vicinity of the outlet 26 of the water jacket 26. The thermostat 28 opens when a temperature of the cooling water flowing through the water jacket 26 becomes equal to or higher than a predetermined reference temperature, and closes when the temperature of the cooling water becomes lower than the reference temperature.

The pressure valve 29 is a valve for lowering a water pressure in the water supply passage 25 or the water jacket 26 by releasing the cooling water discharged from the water pump 24 to the exhaust chamber 17 side when the flow of the cooling water is limited by the thermostat 28. The pressure valve 29 is, for example, a normally closed valve, and is opened when the water pressure in the water supply passage 25 exceeds a predetermined reference pressure.

The collector 31 is a device that collects fine objects contained in the cooling water flowing through the drain passage 27. The collector 31 will be described in detail later.

In the cooling device 21 having such a configuration, when the water pump 24 is operated, the thermostat 28 is opened, and the pressure valve 29 is closed, water around the outboard motor 1 is taken into the outboard motor 1 from the water intake port 22, flows through the water intake passage 23 and the water supply passage 25 in sequence, and is sent to the water jacket 26 as the cooling water. The cooling water sent to the water jacket 26 flows through the water jacket 26, thereby cooling the engine 2. The cooling water flowing through the water jacket 26 flows into the drain passage 27 from the outlet 26A of the water jacket 26, flows through the drain passage 27, passes through the collector 31 in the middle, and is then discharged into the exhaust chamber 17. The cooling water discharged into the exhaust chamber 17 is discharged together with the exhaust gas to the outside of the outboard motor 1 via, for example, the discharge port provided in the shaft portion of the propeller 4. On the other hand, when the water pump 24 is operated, the thermostat 28 is closed, and the pressure valve 29 is opened, the water taken into the outboard motor 1 from the water intake port 22 sequentially flows through the water intake passage 23 and the water supply passage 25, but before reaching the water jacket 26, the water is sent to the exhaust chamber 17 side via the opened pressure valve 29 and discharged into the exhaust chamber 17. The cooling water discharged into the exhaust chamber 17 is discharged to the outside of the outboard motor 1 together with the exhaust gas.

(Collector)

As described above, the collector 31 is a device that collects fine objects contained in the cooling water flowing through the drain passage 27. The fine objects are, for example, fine waste such as microplastic, dregs of feed used for aquaculture, or the like. A size of the fine object is, for example, about 0.1 mm or more and about 5 mm or less. Since the fine objects have such a size, the fine objects are not removed by the strainer or the cover having a large number of small holes provided in the water intake port 22. That is, when the water pump 24 is operated, the thermostat 28 is opened, and the pressure valve 29 is closed, the fine objects enter the outboard motor 1 from the water intake port 22 together with seawater, lake water, river water, or the like, and flows into the collector 31 through the water intake passage 23, the water supply passage 25, the water jacket 26, and an upstream portion 27A of the drain passage 27.

As shown in FIGS. 2 and 3, the collector 31 is disposed on a left side of the rear portion of the engine 2. The collector 31 is provided between the upstream portion 27A and a downstream portion 27B of the drain passage 27. In addition, the collector 31 is disposed in the engine top cover 8 together with a bypass passage 56, which will be described later.

The upstream portion 27A of the drain passage 27 is a portion of the drain passage 27 located in a region extending from an upper side of a middle portion of the engine 2 in the front-rear direction and the middle portion of the engine 2 in the left-right direction to the left of a rear upper portion of the engine 2. Specifically, the upstream portion 27A of the drain passage 27 is a portion of the drain passage 27 extending from the outlet 26A of the water jacket 26 disposed in the upper portion of the cylinder head 14 to a position on a left side of an upper portion of the cylinder head cover 15. The upstream portion 27A of the drain passage 27 is formed of a pipe made of resin having high heat resistance and rigidity or a pipe made of metal having high corrosion resistance, a hose made of a rubber having high heat resistance and rigidity, or the like. In addition, the upstream portion 27A of the drain passage 27 extends leftward from the outlet 26A of the water jacket 26, bends, then extends rearward while being inclined downward on the left side of the rear upper portion of the engine 2 and bends, then extends horizontally rearward on the left side of the upper rear portion of the engine 2 and bends, and then extends vertically downward on the left side of the upper rear portion of the engine 2. Further, a port at a lower end of the upstream portion 27A of the drain passage 27 faces downward.

The downstream portion 27B of the drain passage 27 is a portion of the drain passage 27 located in a region from a lower left portion of the rear portion of the engine 2 to the exhaust chamber 17. An upper end portion of the downstream portion 27B of the drain passage 27 is formed by a drain hole 30 formed in a lower left portion of a rear portion of a housing of the engine 2. In addition, in the downstream portion 27B of the drain passage 27, a portion below the upper end portion thereof is formed by a hose, a pipe, or the like provided inside the engine bottom cover 7, the upper case 9, or the like. The upper end portion of the downstream portion 27B of the drain passage 27, that is, the drain hole 30 is slightly inclined rightward but extends downward, and a port at an upper end of the drain hole 30 faces upward.

Figure 5:
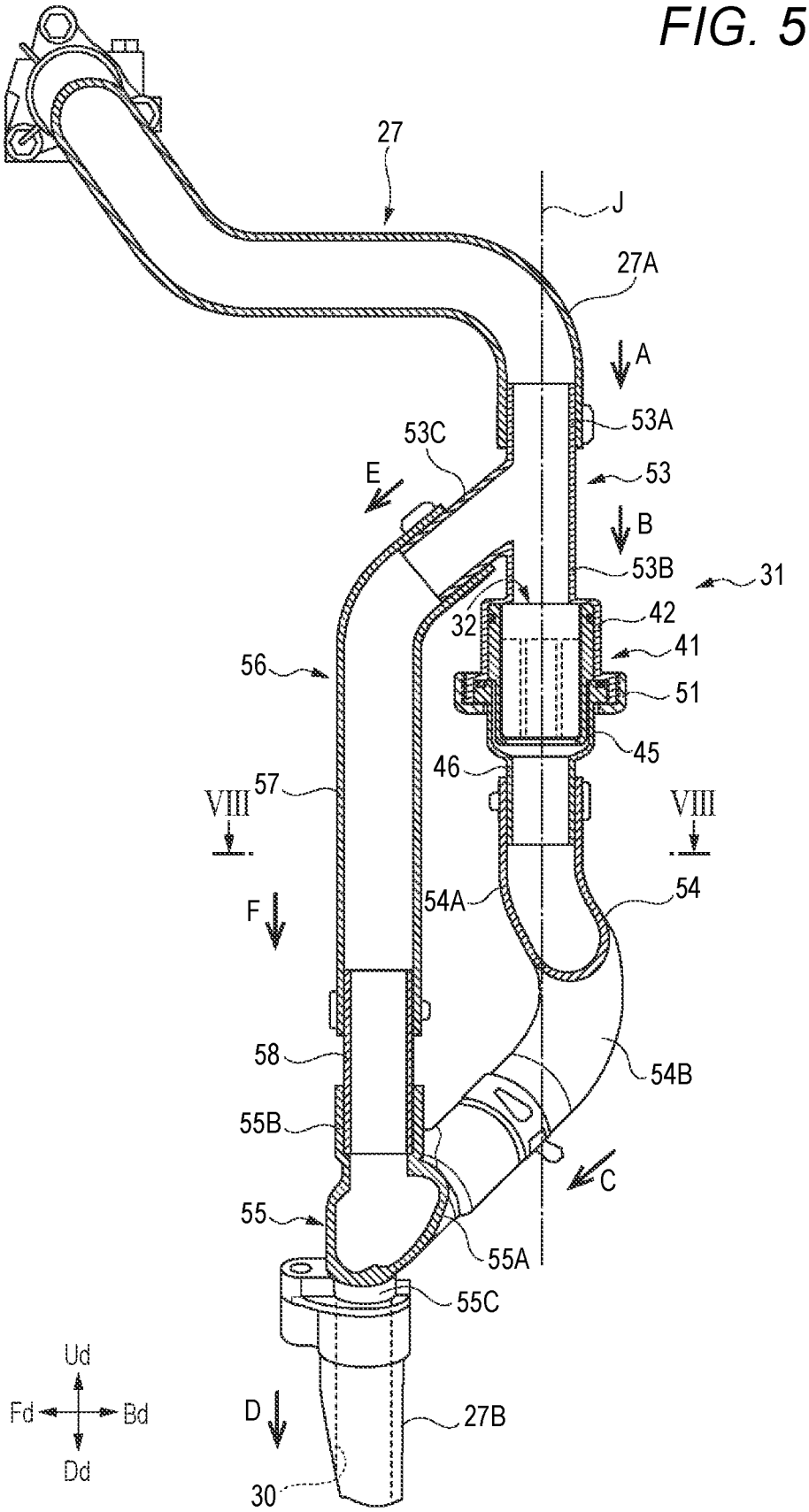
FIG. 5 is a sectional view showing an upstream portion of a drain passage, a collector, a downstream portion of the drain passage, and a bypass passage, which is taken along a cutting line V-V in FIG. 3.

FIG. 5 shows a cross section of the upstream portion 27A of the drain passage 27, the collector 31, the upper end portion of the downstream portion 27B of the drain passage 27, and the bypass passage 56 taken along a cutting line V-V in FIG. 3, as viewed from the left. As shown in FIG. 5, the collector 31 includes a filter cartridge 32, a case 41, a branch pipe 53, a connection hose 54, and a merging pipe 55. The filter cartridge 32 is a specific example of a "collector main body", the branch pipe 53 is a specific example of an "upper connection pipe", and the connection hose 54 is a specific example of a "lower connection pipe".

Figure 6:
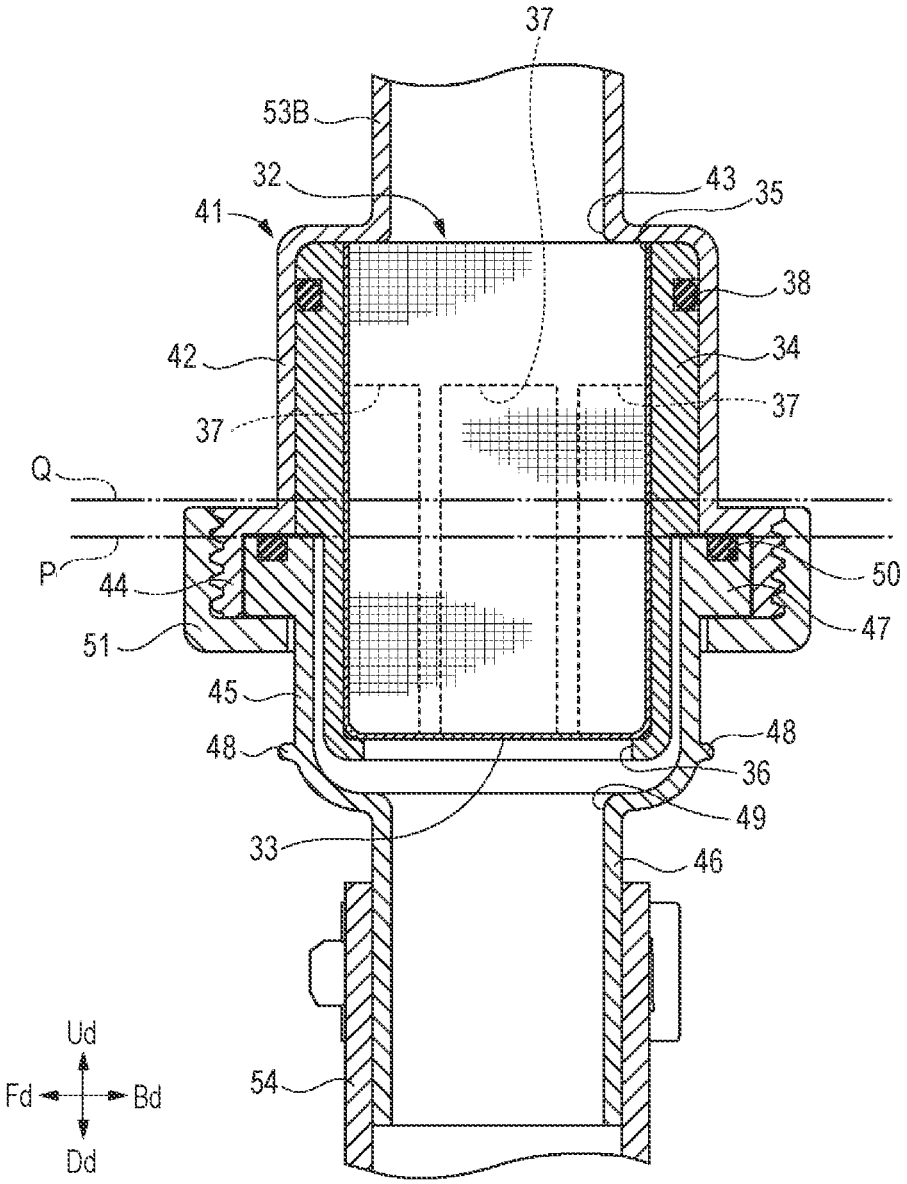
FIG. 6 is an enlarged sectional view showing a case and a filter cartridge shown in FIG. 5.

FIG. 6 is an enlarged view of the filter cartridge 32 and the case 41 in FIG. 5. As shown in FIG. 6, the filter cartridge 32 includes a filter 33 that collects fine objects and allows the cooling water to pass therethrough, and a holder 34 that holds the filter 33. The filter 33 is formed of, for example, a nonwoven fabric, a resin mesh, or the like, and is formed in a bag shape in which an upper side is open and a lower side is closed. The holder 34 is made of resin having high heat resistance and rigidity, metal having high corrosion resistance, or the like, and is formed in a tubular shape having an axis extending in the upper-lower direction. In addition, a plurality of water-flowing holes 37 are provided on a peripheral wall portion of the holder 34. The filter 33 is disposed inside the holder 34 so as to cover the respective water-flowing holes 37 and a lower opening portion 36 of the holder 34. An upper portion of the filter 33 is attached and fixed to an inner peripheral surface of an upper portion of the holder 34 by, for example, an adhesive or the like.

An O-ring 38 is provided in an annular recess formed in an outer peripheral surface of the upper portion of the holder 34. The O-ring 38 is in contact with an inner surface of an upper case portion 42 while pressing the inner surface thereof. The O-ring 38 has a function of preventing the holder 34 from coming off the upper case portion 42 so that the holder 34 does not easily fall off the upper case portion 42 when a lower case portion 45 is separated from the upper case portion 42.

The case 41 is a member that accommodates the filter cartridge 32. The case 41 is made of resin having high heat resistance and rigidity, metal having high corrosion resistance, or the like, and is formed in a tubular shape having an axis extending in the upper-lower direction. In addition, the case 41 is divided into the upper case portion 42 that forms an upper portion of the case 41 and the lower case portion 45 that forms a lower portion of the case 41.

A lower end portion of a first outflow pipe portion 53B of the branch pipe 53 is connected to an upper opening portion 43 of the upper case portion 42. In the present embodiment, the upper case portion 42 is formed integrally with the first outflow pipe portion 53B of the branch pipe 53. A large diameter portion 44 having an outer diameter and an inner diameter larger than those of an upper portion of the upper case portion 42 is formed at a lower portion of the upper case portion 42, and a thread is formed on an outer peripheral surface of the large diameter portion 44.

On the other hand, a connection pipe portion 46 is provided below the lower case portion 45, and the lower case portion 45 and the connection pipe portion 46 are integrated with each other. An upper end portion of the connection hose 54 is connected to a lower end portion of the connection pipe portion 46. In addition, a flange portion 47 having an outer diameter larger than an outer diameter of a lower portion of the lower case portion 45 is formed at an upper portion of the lower case portion 45, and the flange portion 47 is inserted into the large diameter portion 44 of the upper case portion 42.

The lower case portion 45 is separably coupled to the upper case portion 42 by a coupling member 51. That is, the coupling member 51 that separably couples the lower case portion 45 to the upper case portion 42 is provided on an outer peripheral side of the lower case portion 45. The coupling member 51 is made of, for example, resin or metal and is formed in a tubular shape. An inner diameter of an upper portion of the coupling member 51 is substantially equal to an outer diameter of the large diameter portion 44 of the upper case portion 42, and a thread to be screwed with the thread formed in the large diameter portion 44 of the upper case portion 42 is formed on an inner surface of the upper portion of the coupling member 51. An inner diameter of a lower portion of the coupling member 51 is smaller than an outer diameter of the flange portion 47 of the lower case portion 45 and larger than the outer diameter of the lower portion of the lower case portion 45. The coupling member 51 can rotate around the lower case portion 45. By screwing the coupling member 51 to the large diameter portion 44 of the upper case portion 42, the lower case portion 45 can be coupled and fixed to the upper case portion 42. In addition, by removing the coupling member 51 from the large diameter portion 44 of the upper case portion 42, the lower case portion 45 can be separated from the upper case portion 42. In addition, a protruding portion 48 for preventing the coupling member 51 from falling off from the lower case portion 45 when the coupling member 51 is removed from the large diameter portion 44 of the upper case portion 42 is formed on an outer peripheral surface of a lower end portion of the lower case portion 45.

An O-ring 50 for sealing between the upper case portion 42 and the lower case portion 45 when the lower case portion 45 is coupled to the upper case portion 42 is provided on an upper surface of the lower case portion 45.

An upper portion of the filter cartridge 32 is mounted in the upper case portion 42, and is retained in the upper case portion 42 by the O-ring 38 provided in the upper portion of the holder 34. In a state in which the lower case portion 45 is coupled to the upper case portion 42, a lower portion of the filter cartridge 32 is covered by the lower case portion 45, and the filter cartridge 32 is held between the upper case portion 42 and the lower case portion 45. In addition, the filter cartridge 32 is disposed coaxially with the case 41, a position of an upper opening portion 35 of the holder 34 of the filter cartridge 32 and a position of the upper opening portion 43 of the upper case portion 42 coincide with each other, and a position of the lower opening portion 36 of the holder 34 and a position of a lower opening portion 49 of the lower case portion 45 coincide with each other.

In addition, a two-dot chain line P in FIG. 6 indicates a position of an upper end of the lower case portion 45 in the upper-lower direction in a state in which the lower case portion 45 is coupled to the upper case portion 42. In addition, a two-dot chain line Q in FIG. 6 indicates a central position of the filter cartridge 32 in the upper-lower direction in a state in which the filter cartridge 32 is held between the upper case portion 42 and the lower case portion 45, which are coupled to each other. As can be seen from the two-dot chain lines P and Q, in a state in which the lower case portion 45 is coupled to the upper case portion 42 and the filter cartridge 32 is held between the upper case portion 42 and the lower case portion 45, the upper end of the lower case portion 45 is located below a center of the filter cartridge 32 in the upper-lower direction.

The cooling water sequentially passes through the upper opening portion 43 of the upper case portion 42 and the upper opening portion 35 of the holder 34 from the first outflow pipe portion 53B of the branch pipe 53, and flows into the bag-shaped filter 33 disposed in the holder 34 of the filter cartridge 32. The cooling water flowing into the filter 33 passes through the filter 33, sequentially passes through the lower opening portion 36 of the holder 34, the lower opening portion 49 of the lower case portion 45, and the connection pipe portion 46, and flows into the connection hose 54. When the cooling water passes through the filter 33, the fine objects in the cooling water are captured by the filter 33, and are removed from the cooling water.

As shown in FIG. 5, the branch pipe 53 is a pipe that connects the upstream portion 27A of the drain passage 27 and the case 41, and connects the upstream portion 27A of the drain passage 27 and the bypass passage 56. The branch pipe 53 is made of resin having high heat resistance and rigidity, metal having high corrosion resistance, or the like. The branch pipe 53 includes an inflow pipe portion 53A, the first outflow pipe portion 53B, and a second outflow pipe portion 53C.

In the branch pipe 53, the inflow pipe portion 53A is located on an upper side, and the first outflow pipe portion 53B is located on a lower side. The inflow pipe portion 53A and the first outflow pipe portion 53B are coaxially disposed, and a portion of the branch pipe 53 from the inflow pipe portion 53A to the first outflow pipe portion 53B extends linearly in the upper-lower direction. An upper end portion of the inflow pipe portion 53A is connected to a lower end portion of the upstream portion 27A of the drain passage 27, and the lower end portion of the first outflow pipe portion 53B is connected to the upper opening portion 43 of the upper case portion 42 (in the present embodiment, as described above, the first outflow pipe portion 53B and the upper case portion 42 are integrally formed). In addition, the inflow pipe portion 53A is disposed coaxially with the lower end portion of the upstream portion 27A of the drain passage 27, and the first outflow pipe portion 53B is disposed coaxially with the case 41.

The second outflow pipe portion 53C extends forward while being inclined downward from a substantially middle portion in the upper-lower direction of a portion of the branch pipe 53 from the inflow pipe portion 53A to the first outflow pipe portion 53B. An upper end portion of a bypass pipe 57 forming an upper portion of the bypass passage 56 is connected to a lower end portion of the second outflow pipe portion 53C.

The connection hose 54 is a pipe that connects the case 41 and a first inflow pipe portion 55A of the merging pipe 55. The connection hose 54 is formed of a rubber hose having high heat resistance and rigidity. For example, in the case of the outboard motor 1 equipped with the engine 2 having an exhaust amount of about 2000 $cm^3$ and a maximum output of about 103 kW (140 PS), a reinforcing fiber-containing rubber hose having an outer diameter of 34 mm, a hose wall thickness of 3.5 mm, and a rubber hardness of 65 to 75 (durometer A hardness) is used as the connection hose 54. Although the connection hose 54 has flexibility, the connection hose 54 is hard to bend because the connection hose 54 has high rigidity. An upper end portion of the connection hose 54 is connected to the lower end portion of the connection pipe portion 46 formed integrally with the lower case portion 45. A lower end portion of the connection hose 54 is connected to the upper end portion of the first inflow pipe portion 55A of the merging pipe 55. In addition, the upper end portion of the connection hose 54 is disposed coaxially with the case 41.

In the connection hose 54, an upper bent portion 54A is provided between the upper end portion and the lower end portion thereof, and a lower bent portion 54B is provided between the upper bent portion 54A and the lower end portion thereof. As will be described in detail later, the upper bent portion 54A and the lower bent portion 54B have a function of facilitating bending of the connection hose 54 when the lower case portion 45 is moved downward to be separated from the upper case portion 42. In the present embodiment, the lower bent portion 54B is disposed substantially at a center between the upper end portion and the lower end portion of the connection hose 54, and the upper bent portion 54A is disposed substantially at a center between the upper end portion of the connection hose 54 and the lower bent portion 54B.

The connection hose 54 extends downward from the upper end portion thereof along an axis J of the case 41, bends at the upper bent portion 54A, extends downward while being inclined with respect to the axis J so as to be separated from the axis J, bends at the lower bent portion 54B, and then extends downward while being inclined with respect to the axis J so as to be close to the axis J. As shown in FIGS. 2 and 3, a portion of the connection hose 54 extending from the upper bent portion 54A to the lower bent portion 54B extends downward while being inclined rearward of the engine 2 and toward a center side (right side) of the engine 2 in the left-right direction. In addition, a portion of the connection hose 54 from the lower bent portion 54B to the lower end portion thereof extends downward while being inclined leftward and forward.

Although the connection hose 54 includes the upper bent portion 54A and the lower bent portion 54B as described above, a portion of the connection hose 54 from an upper end thereof to the upper bent portion 54A extends downward along the axis J of the case 41, a portion of the connection hose 54 from the upper bent portion 54A to the lower bent portion 54B extends downward while being inclined with respect to the axis J, and a portion of the connection hose 54 from the lower bent portion 54B to the lower end portion thereof extends downward while being inclined with respect to the axis J. Therefore, the connection hose 54 extends in the upper-lower direction between the case 41 and the merging pipe 55 as a whole. The upper bent portion 54A is a specific example of a "first bent portion", and the lower bent portion 54B is a specific example of a "second bent portion".

The merging pipe 55 is a pipe that connects the connection hose 54 and the downstream portion 27B of the drain passage 27, and connects the bypass passage 56 and the downstream portion 27B of the drain passage 27. The merging pipe 55 is made of resin having high heat resistance and rigidity, metal having high corrosion resistance, or the like. The merging pipe 55 includes the first inflow pipe portion 55A, a second inflow pipe portion 55B, and an outflow pipe portion 55C.

In the merging pipe 55, the second inflow pipe portion 55B is located on an upper side thereof, and the outflow pipe portion 55C is located on a lower side thereof. The second inflow pipe portion 55B and the outflow pipe portion 55C are coaxially disposed, and a portion of the merging pipe 55 from the second inflow pipe portion 55B to the outflow pipe portion 55C linearly extends in the upper-lower direction. In addition, a lower end portion of a connection pipe 58 forming a lower portion of the bypass passage 56 is connected to an upper end portion of the second inflow pipe portion 55B, and a lower end portion of the outflow pipe portion 55C is connected to an upper end portion of the downstream portion 27B (drain hole 30) of the drain passage 27.

The first inflow pipe portion 55A extends rearward while being inclined rightward and upward from a substantially middle portion in the upper-lower direction of a portion of the merging pipe 55 from the second inflow pipe portion 55B to the outflow pipe portion 55C. The lower end portion of the connection hose 54 is connected to the upper end portion of the first inflow pipe portion 55A. In addition, the inner diameters of the inflow pipe portion 53A of the branch pipe 53, the first outflow pipe portion 53B of the branch pipe 53, the connection hose 54, and the first inflow pipe portion 55A of the merging pipe 55 are substantially equal to each other.

(Bypass Passage)

In the cooling device 21, the bypass passage 56 is provided between the upstream portion 27A and the downstream portion 27B of the drain passage 27. The bypass passage 56 is connected in parallel with a passage formed by the filter cartridge 32, the case 41, and the connection hose 54 between the upstream portion 27A and the downstream portion 27B of the drain passage 27. The bypass passage 56 is a passage for allowing the cooling water to smoothly flow from the upstream portion 27A to the downstream portion 27B of the drain passage 27 in a case where a large amount of fine objects are accumulated in the filter 33 and the filter 33 is clogged. That is, in a case where the filter 33 is clogged or the like, since the cooling water hardly passes through the filter 33, it is difficult for the cooling water flowing out from the upstream portion 27A of the drain passage 27 to flow through the passage formed by the filter cartridge 32, the case 41, and the connection hose 54. In this case, the cooling water flowing out from the upstream portion 27A of the drain passage 27 flows through the bypass passage 56.

The bypass passage 56 is formed by the bypass pipe 57 and the connection pipe 58. The bypass pipe 57 is formed of a hose made of rubber having high heat resistance and rigidity, a pipe made of resin having high heat resistance and rigidity, a pipe made of metal having high corrosion resistance, or the like. The upper end portion of the bypass pipe 57 is connected to the lower end portion of the second outflow pipe portion 53C of the branch pipe 53, and a lower end portion of the bypass pipe 57 is connected to an upper end portion of the connection pipe 58. The bypass pipe 57 extends downward from the upper end thereof while being inclined forward with respect to the axis J of the case 41, bents, and then extends in the upper-lower direction so as to be parallel to the axis J of the case 41. The connection pipe 58 is made of resin having high heat resistance and rigidity, metal having high corrosion resistance, or the like. The lower end portion of the connection pipe 58 is connected to the upper end portion of the second inflow pipe portion 55B of the merging pipe 55. The connection pipe 58 extends in the upper-lower direction and is disposed coaxially with the bypass pipe 57. The inner diameters of the second outflow pipe portion 53C of the branch pipe 53, the bypass pipe 57, the connection pipe 58, and the second inflow pipe portion 55B of the merging pipe 55 are substantially equal to each other. In addition, the inner diameters of the second outflow pipe portion 53C of the branch pipe 53, the bypass pipe 57, the connection pipe 58, and the second inflow pipe portion 55B of the merging pipe 55 are substantially equal to the inner diameters of the inflow pipe portion 53A of the branch pipe 53, the first outflow pipe portion 53B of the branch pipe 53, the connection hose 54, and the first inflow pipe portion 55A of the merging pipe 55.

(Flow of Cooling Water in Collector and Bypass Passage)

In FIG. 5, as indicated by an arrow A, the cooling water flows into the inflow pipe portion 53A of the branch pipe 53 from the upstream portion 27A of the drain passage 27. Here, the inflow pipe portion 53A of the branch pipe 53, the first outflow pipe portion 53B of the branch pipe 53, and the case 41 are coaxially disposed, and a flow path from the inflow pipe portion 53A of the branch pipe 53 to the case 41 extends linearly in the upper-lower direction. On the other hand, the second outflow pipe portion 53C of the branch pipe 53 is inclined with respect to the inflow pipe portion 53A of the branch pipe 53, and a flow path from the inflow pipe portion 53A of the branch pipe 53 to the bypass pipe 57 is bent. Therefore, when clogging or the like of the filter 33 does not occur, most of the cooling water flowing into the inflow pipe portion 53A of the branch pipe 53 flows into the case 41 through the first outflow pipe portion 53B of the branch pipe 53 as indicated by an arrow B. The cooling water flowing into the case 41 passes through the filter 33, flows out from the case 41, and flows into the connection hose 54. When the cooling water passes through the filter 33, fine objects in the cooling water are removed. The cooling water flowing into the connection hose 54 flows through the connection hose 54, flows into the first inflow pipe portion 55A of the merging pipe 55 as indicated by an arrow C, and then flows into the downstream portion 27B of the drain passage 27 from the outflow pipe portion 55C of the merging pipe 55 as indicated by an arrow D.

A flow path from the upstream portion 27A of the drain passage 27 to the downstream portion 27B of the drain passage 27 through the inflow pipe portion 53A of the branch pipe 53, the first outflow pipe portion 53B of the branch pipe 53, the case 41, the connection hose 54, the first inflow pipe portion 55A of the merging pipe 55, and the outflow pipe portion 55C of the merging pipe 55 does not have a large bent portion. Therefore, when clogging or the like of the filter 33 does not occur, the cooling water smoothly flows from the upstream portion 27A of the drain passage 27 to the downstream portion 27B of the drain passage 27 through the inflow pipe portion 53A of the branch pipe 53, the first outflow pipe portion 53B of the branch pipe 53, the case 41, the connection hose 54, the first inflow pipe portion 55A of the merging pipe 55, and the outflow pipe portion 55C of the merging pipe 55.

On the other hand, when clogging or the like of the filter 33 occurs, it is difficult for the cooling water to pass through the filter 33, and the flow of the cooling water is stagnant in the case 41 and the first outflow pipe portion 53B of the branch pipe 53. Therefore, when clogging or the like of the filter 33 occurs, most of the cooling water flowing into the inflow pipe portion 53A of the branch pipe 53 from the upstream portion 27A of the drain passage 27 flows into the bypass pipe 57 through the second outflow pipe portion 53C of the branch pipe 53 as indicated by an arrow E. The cooling water flowing into the bypass pipe 57 sequentially passes through the bypass pipe 57 and the connection pipe 58, flows into the second inflow pipe portion 55B of the merging pipe 55 as indicated by an arrow F, and subsequently flows into the downstream portion 27B of the drain passage 27 from the outflow pipe portion 55C of the merging pipe 55 as indicated by the arrow D.

(Detachment and Attachment of Lower Case Portion)

By performing navigation of a ship using the outboard motor 1, fine objects are captured by the filter 33 of the collector 31, and the captured fine objects are accumulated in the filter 33. Therefore, the user removes the fine objects accumulated in the filter 33 after using the outboard motor 1. After the outboard motor 1 is used for a long period of time, the user replaces the filter cartridge 32. When such maintenance of the collector 31 is performed, the user separates the lower case portion 45 from the upper case portion 42 and removes the filter cartridge 32 from the upper case portion 42.

Figure 7A:
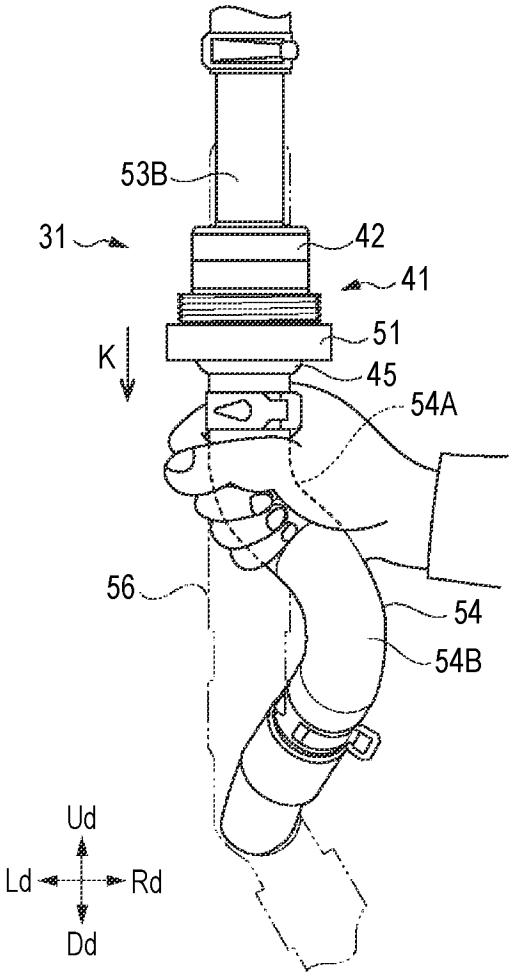
FIGS. 7A and 7C are explanatory views showing a method of removing the filter cartridge from an upper case portion by separating a lower case portion from the upper case portion in the embodiment of the present disclosure.
Figure 7B:
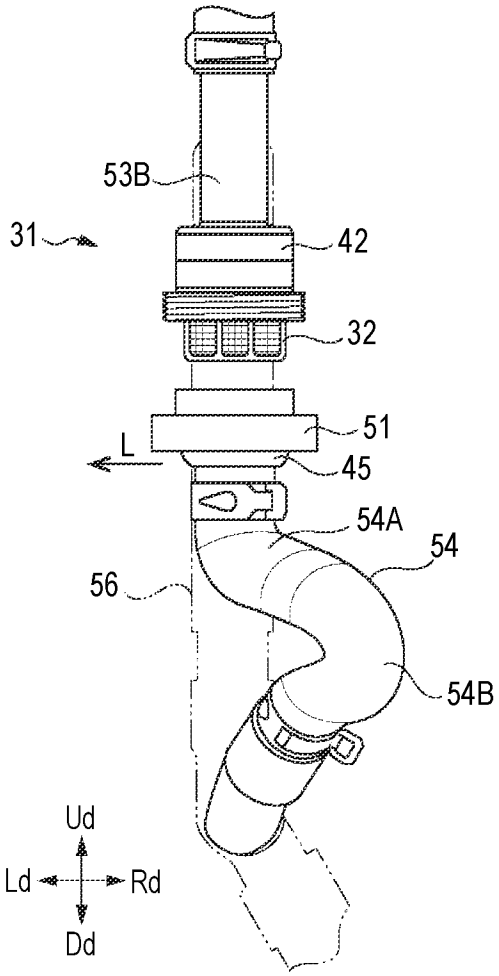
Figure 7C:
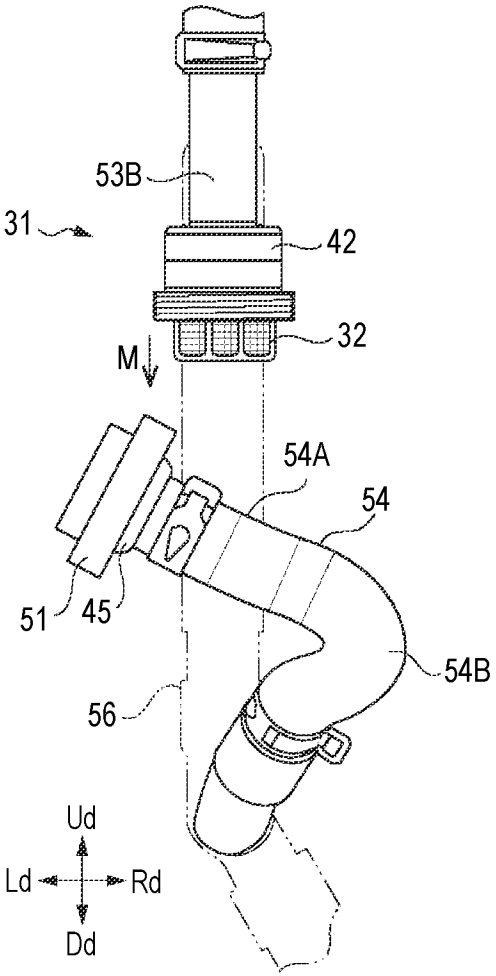

FIGS. 7A and 7C show a method of removing the filter cartridge 32 from the upper case portion 42 by separating the lower case portion 45 from the upper case portion 42. First, the user rotates the coupling member 51 of the case 41 in a direction in which the screwing is released, and removes the coupling member 51 from the large diameter portion 44 of the upper case portion 42. Next, as shown in FIG. 7A, the user grips the upper portion of the connection hose 54 with his/her hand and pushes down the connection hose 54 as indicated by an arrow K in FIG. 7A. When the upper portion of the connection hose 54 is pushed down, the lower case portion 45 moves downward, and as shown in FIG. 7B, the lower case portion 45 is separated from the upper case portion 42. Next, the user pushes and moves the upper portion of the connection hose 54 in a direction separated from the engine 2 (substantially leftward) as indicated by an arrow L in FIG. 7B, and moves the lower case portion 45 to a position deviated from directly below the upper case portion 42. As shown in FIG. 7C, after the lower case portion 45 is moved to a position deviated from directly below the upper case portion 42, the user pulls down the filter cartridge 32 mounted on the upper case portion 42 as shown by an arrow M in FIG. 7C and removes the filter cartridge 32 from the upper case portion 42.

Thereafter, the user removes the fine objects accumulated in the filter 33, mounts the filter cartridge 32 from which the fine objects have been removed on the upper case portion 42, or mounts a new filter cartridge 32 on the upper case portion 42, and then mounts the lower case portion 45 to the upper case portion 42 to couple the lower case portion 45 to the upper case portion 42.

As described above, although the connection hose 54 has flexibility, the connection hose 54 is hard to bend because of its high rigidity. However, in the outboard motor 1 of the present embodiment, as shown in FIGS. 7A and 7C, the user can grip and push down the upper portion of the connection hose 54 by hands to separate the lower case portion 45 from the upper case portion 42. This point will be described below.

If the connection hose extends linearly in the upper-lower direction from the case 41 to the first inflow pipe portion 55A of the merging pipe 55, it is difficult for the user to push down the connection hose even if the user grips the upper portion of the connection hose with his/her hand and applies a downward force, and it is difficult to separate the lower case portion 45 from the upper case portion 42. One of the reasons is that a direction of the force applied to the connection hose coincides with an extending direction of the connection hose, and thus the connection hose is extremely difficult to bend.

However, in the outboard motor 1 of the present preferred embodiment, the connection hose 54 is provided with the upper bent portion 54A and the lower bent portion 54B, and the portion of the connection hose 54 from the upper bent portion 54A to the lower bent portion 54B and the portion of the connection hose 54 from the lower bent portion 54B to the lower end portion extend in a direction intersecting the axis J of the case 41 extending in the upper-lower direction. Therefore, when the user grips the upper portion of the connection hose 54 with his/her hand and applies the downward force, the direction of the force and an extending direction of the portion of the connection hose 54 from the upper bent portion 54A to the lower bent portion 54B are different from each other, and the direction of the force and an extending direction of the portion of the connection hose 54 from the lower bent portion 54B to the lower end portion are different from each other. Therefore, the connection hose 54 is more easily bent than in the case where the connection hose 54 extends linearly in the upper-lower direction as described above. Therefore, the user can easily push down the connection hose 54 by gripping the upper portion of the connection hose 54 with his/her hand and applying the downward force, and can easily separate the lower case portion 45 from the upper case portion 42.

(Positional Relationship between Connection Hose and Bypass Pipe)

Figure 8:
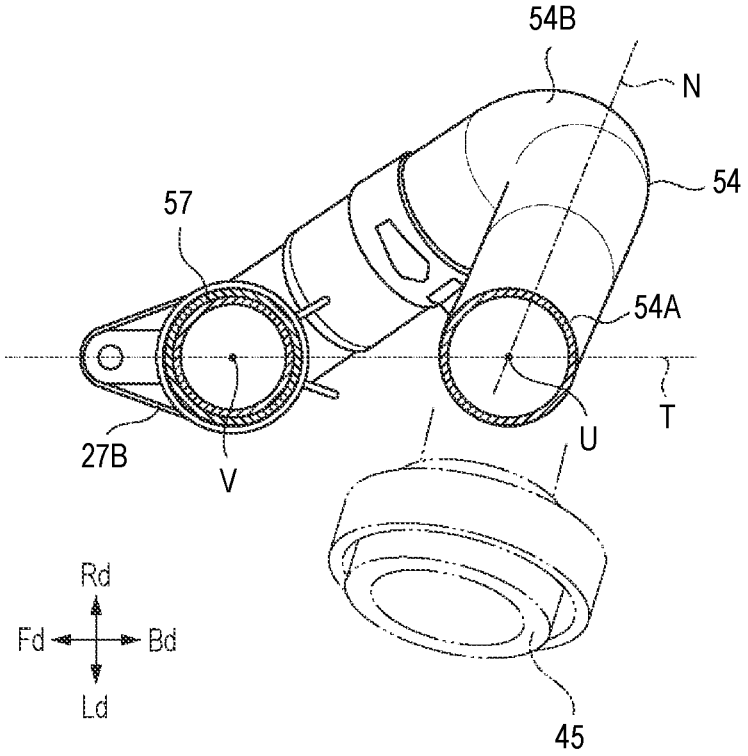
FIG. 8 is a sectional view showing a connection hose, a bypass pipe, and the like taken along a cutting line VIII-VIII in FIG. 5, as viewed from above.

FIG. 8 shows a cross section of the connection hose 54 and the bypass pipe 57 cut along a cutting line VIII-VIII in FIG. 5 as viewed from above. As shown in FIG. 8, when the connection hose 54 and the bypass pipe 57 are viewed from above, an axis N of a portion of the connection hose 54 from the upper bent portion 54A to the lower bent portion 54B intersects a straight line T that passes through both an axial center U of the upper end portion of the connection hose 54 and an axial center V of a portion of the bypass pipe 57 excluding the inclined upper end portion.

Since the connection hose 54 and the bypass pipe 57 are disposed in this manner, the lower bent portion 54B and the like of the connection hose 54 do not come into contact with the bypass pipe 57. In addition, when the lower case portion 45 is separated from the upper case portion 42 and the filter cartridge 32 is removed from the upper case portion 42, the lower case portion 45 separated from the upper case portion 42 does not come into contact with the bypass pipe 57 as indicated by a two-dot chain line in FIG. 8. The two-dot chain line in FIG. 8 shows the lower case portion 45 in a state of being pushed and moved to a position shown in FIG. 7C.

As described above, in the collector 31 included in the cooling device 21 of the embodiment of the present disclosure, the case 41 accommodating the filter cartridge 32 is formed in a tubular shape having the axis extending in the upper-lower direction, the upstream portion 27A of the drain passage 27 and the case 41 are connected by the inflow pipe portion 53A and the first outflow pipe portion 53B of the branch pipe 53 extending in the upper-lower direction, and the case 41 and the downstream portion 27B of the drain passage 27 are connected by the connection hose 54 extending in the upper-lower direction as viewed as a whole, although the connection hose 54 includes the bent portions 54A and 54B. As described above, the flow path of the cooling water in the collector 31 provided between the upstream portion 27A of the drain passage 27 and the downstream portion 27B of the drain passage 27 is not largely bent, unlike the flow path of the related art shown in FIG. 9B. Therefore, it is possible to prevent an increase in a pressure loss in the flow path of the cooling water in the collector 31, and it is possible to improve the flow of the cooling water in the collector 31.

In the collector 31 of the cooling device 21 of the present embodiment, the connection hose 54 is provided with the upper bent portion 54A and the lower bent portion 54B, and the portion of the connection hose 54 from the upper bent portion 54A to the lower bent portion 54B and the portion of the connection hose 54 from the lower bent portion 54B to the lower end portion are inclined with respect to the axis J of the case 41 extending in the upper-lower direction. Therefore, when the user grips the upper portion of the connection hose 54 with his/her hand and applies a downward force, the user can easily bend the connection hose 54 and can easily separate the lower case portion 45 from the upper case portion 42 by moving the lower case portion 45 connected to the upper end portion of the connection hose 54 downward. As a result, the user can easily perform maintenance of the collector 31.

In the connection hose 54, the portion thereof from the upper bent portion 54A to the lower bent portion 54B extends downward while being inclined rearward of the engine 2 and toward the center side of the engine 2 in the left-right direction. Accordingly, it is possible to prevent a portion of the connection hose 54, for example, the lower bent portion 54B, from protruding outward in a lateral direction of the engine 2. Therefore, it is possible to reduce the size of the engine top cover 8 that covers the engine 2 in which the collector 31 is disposed, and it is possible to reduce the size of the outboard motor 1.

In a state in which the lower case portion 45 is coupled to the upper case portion 42, the upper end of the lower case portion 45 is located below the center of the filter cartridge 32 in the upper-lower direction. Accordingly, when the lower case portion 45 is separated from the upper case portion 42, an amount of downward movement of the lower case portion 45 can be reduced. Therefore, it is possible to further facilitate an operation of removing the filter cartridge 32 from the upper case portion 42 by separating the lower case portion 45 from the upper case portion 42.

As shown in FIG. 8, when the connection hose 54 and the bypass pipe 57 are viewed from above, the axis N of the portion of the connection hose 54 from the upper bent portion 54A to the lower bent portion 54B intersects the straight line T that passes through both the axial center U of the upper end portion of the connection hose 54 and the axial center V of the portion of the bypass pipe 57 excluding the inclined upper end portion. With this configuration, the lower bent portion 54B and the like of the connection hose 54 can be prevented from coming into contact with the bypass pipe 57. In addition, when the lower case portion 45 is separated from the upper case portion 42 and the filter cartridge 32 is removed from the upper case portion 42, it is possible to prevent the lower case portion 45 separated from the upper case portion 42 from coming into contact with the bypass pipe 57.

In addition, the cooling device 21 including the collector 31 capable of collecting the microplastic is provided in the outboard motor 1, it is possible to collect the microplastic diffused in seawater, lake water, river water, or the like at the same time as sailing of the ship, and clean the sea, lake, or river.

In the above embodiment, the upper end portion of the connection hose 54 and the lower case portion 45 unseparably connected to the upper end portion of the connection hose 54 are moved downward together to allow the filter cartridge 32 to be removable from the case 41, but the present disclosure is not limited thereto. For example, the case 41 and the branch pipe 53 may be separably connected, the case 41 and the connection hose 54 may be separably connected, and only the upper end portion of the connection hose 54 may be pushed downward to separate the case 41 from both the branch pipe 53 and the connection hose 54. This makes it possible to remove the entire case 41 from the outboard motor 1 and remove fine objects accumulated in the filter 33.

Although the collector 31 is disposed on the left side of the rear portion of the engine 2 in the above embodiment, the collector 31 may be disposed at another position around the engine 2, such as on the right side of the rear portion of the engine 2.

The power source of the outboard motor 1 is not limited to the engine, and may be an electric motor. In addition, the cooling device of the present disclosure is not limited to the outboard motor, and may be provided in other types of ship propulsion machines such as an inboard-outboard motor or an inboard motor.

In addition, the present disclosure can be appropriately modified without departing from the scope or spirit of the disclosure which can be read from claims and the entire specification, and a cooling device for a ship propulsion machine accompanied by such a modification is also included in the technical concept of the present disclosure.

What is claimed is:

1. A cooling device for a ship propulsion machine, the cooling device being provided in the ship propulsion machine, taking water of an outside of the ship propulsion machine into the ship propulsion machine, cooling a power source of the ship propulsion machine by flowing the taken water around or inside the power source as cooling water, and discharging the cooling water after flowing around or inside the power source to outside of the ship propulsion machine, the cooling device comprising:

a drain passage configured to discharge the cooling water after flowing around or inside the power source to the outside of the ship propulsion machine; and a collector provided between an upstream portion and a downstream portion of the drain passage and configured to collect a fine object contained in the cooling water flowing from the upstream portion of the drain passage toward the downstream portion of the drain passage, wherein the collector includes a collector main body configured to collect the fine object, through which the cooling water passes, a case having a tubular shape having an axis extending in an upper-lower direction and accommodating the collector main body, an upper connection pipe extending in the upper-lower direction, whose upper end portion is connected to the upstream portion of the drain passage, whose lower end portion is connected to an upper portion of the case, and through which the cooling water flows from the upstream portion of the drain passage into the case, and a lower connection pipe having flexibility, whose upper end portion is connected to a lower portion of the case, whose lower end portion is connected to the downstream portion of the drain passage, and through which the cooling water flows from the case into the downstream portion of the drain passage, wherein a first bent portion is provided between the upper end portion and the lower end portion of the lower connection pipe, wherein a second bent portion is provided between the first bent portion and the lower end portion of the lower connection pipe, and wherein the lower connection pipe extends downward from the upper end portion thereof along an axis of the case, bends at the first bent portion, extends downward while being inclined with respect to the axis so as to be separated from the axis, bends at the second bent portion, and extends downward while being inclined with respect to the axis so as to be close to the axis.

2. The cooling device for a ship propulsion machine according to claim 1, wherein the collector is configured to be disposed on a side of a rear portion of the power source, and wherein a portion of the lower connection pipe from the first bent portion to the second bent portion is configured to extend downward while being inclined rearward of the power source and toward a center side of the power source in a left-right direction.

3. The cooling device for a ship propulsion machine according to claim 1, wherein the case includes an upper case portion forming the upper portion of the case, to which the lower end portion of the upper connection pipe is connected, and a lower case portion forming the lower portion of the case, to which the upper end portion of the lower connection pipe is connected, the lower case portion being coupled to the upper case portion so as to be separable in the upper-lower direction, and wherein the lower case portion is movable in the upper-lower direction with respect to the upper case portion by bending of a portion of the lower connection pipe from the first bent portion to the second bent portion or bending of a portion of the lower connection pipe from the second bent portion to the lower end portion.

4. The cooling device for a ship propulsion machine according to claim 3, wherein an upper end of the lower case portion is located below a center of the collector main body in the upper-lower direction in a state where the lower case portion is coupled to the upper case portion.

5. The cooling device for a ship propulsion machine according to claim 1, further comprising:

a bypass passage provided in parallel with a passage formed by the collector main body, the case, and the lower connection pipe between the upstream portion and the downstream portion of the drain passage, connecting the upstream portion and the downstream portion of the drain passage, and extending in the upper-lower direction, wherein when the lower connection pipe and the bypass passage are viewed from above, an axis of the portion of the lower connection pipe from the first bent portion to the second bent portion intersects a straight line passing through both an axial center of the upper end portion of the lower connection pipe and an axial center of the bypass passage.

6. The cooling device for a ship propulsion machine according to claim 1, wherein the collector is configured to collect a microplastic.

* * * * *